US005343928A

United States Patent [19]

Hunter

[11] Patent Number: 5,343,928

[45] Date of Patent: Sep. 6, 1994

[54] TWO-PIECE LINER FOR USE IN A MATCHPLATE MOLDING MACHINE

[75] Inventor: William A. Hunter, Naples, Fla.

[73] Assignee: Hunter Automated Machinery Corporation, Schaumburg, Ill.

[21] Appl. No.: 100,298

[22] Filed: Aug. 2, 1993

[51] Int. Cl.[5] ..... B22C 15/02; B22C 23/00

[52] U.S. Cl. ..... 164/158; 164/182; 164/187; 164/239; 164/242; 164/244

[58] Field of Search ..... 164/158, 182, 187, 239, 164/242, 244

[56] References Cited

U.S. PATENT DOCUMENTS

| | | | |
|---|---|---|---|
| 2,275,806 | 3/1942 | Perazo | 164/162 |
| 3,234,602 | 2/1966 | Hunter et al. | 164/244 X |
| 3,970,138 | 7/1976 | Bührer | 164/244 |
| 5,069,268 | 12/1991 | Hunter | 164/158 |

FOREIGN PATENT DOCUMENTS

| | | | |
|---|---|---|---|
| 50-38057 | 12/1975 | Japan | 164/244 |
| 240948 | 9/1969 | U.S.S.R. | 164/244 |
| 546423 | 4/1977 | U.S.S.R. | 164/244 |
| 554059 | 7/1977 | U.S.S.R. | 164/244 |

*Primary Examiner*—J. Reed Batten, Jr.
*Attorney, Agent, or Firm*—Leydig, Voit & Mayer

[57] ABSTRACT

An automatic matchplate molding machine, used to form sand cope and drag molds, includes a basin former to create a pouring basin in the cope mold. The basin former includes a two-piece liner, one of the pieces being a relatively short and inexpensive plastic sleeve which may be replaced at a relatively low cost when wear occurs. Air passages in the liner channel air into the center of the liner, creating a swirling air current, thereby blowing loose sand out of the liner.

6 Claims, 2 Drawing Sheets

TWO-PIECE LINER FOR USE IN A MATCHPLATE MOLDING MACHINE

BACKGROUND OF THE INVENTION

This invention relates to a molding machine and more particularly to an automatic matchplate molding machine of the type in which a pattern plate is located between cope and drag flasks adapted to be filled with sand and adapted to be rammed upwardly toward a squeeze head in order to pack the sand and form cope and drag molds in the cope and drag flasks, respectively. A machine of this general type is disclosed in Hunter U.S. Pat. No. 4,840,218.

The pattern plate of such a machine carries an upwardly projecting sprue former which forms a sprue in the cope mold. Coacting with the sprue former is a basin former which creates a pouring basin in the upper side of the cope mold around the sprue. The basin former is carried by the squeeze head and telescopically receives the sprue former when the cope flask and the pattern plate are rammed upwardly toward the squeeze head. When the two formers are telescoped together, a small sand core may be created in the basin former and may fall downwardly into the pouring basin and the sprue when the cope flask and the cope mold are retracted downwardly from the squeeze head.

To prevent loose sand from falling downwardly when the cope flask and cope mold are retracted, a one-piece plastic liner with means for injecting pressurized air through the side of the liner has been employed to blow sand in the basin former out of the upper end thereof and away from the mold. A liner of this type is disclosed in Hunter U.S. Pat. No. 5,069,268. During operation, the liner telescopically receives the sprue former and, as a result of repeated sliding of the sprue former within the liner, the latter wears and eventually must be replaced. The one-piece liner of the '268 patent is comparatively large and thus is relatively expensive to replace.

SUMMARY OF THE INVENTION

The general aim of the present invention is to provide a molding machine of the above general type having a new and improved liner which is simpler and less expensive than prior liners so as to significantly reduce replacement costs.

A more detailed object of the invention is to achieve the foregoing by producing a unique two-piece liner, one of the pieces being a relatively short and inexpensive plastic sleeve which may be replaced at a relatively low cost when wear occurs.

The invention also resides in the provision of unique air passages formed by the assembly of the two separate sections of the liner to effect better air circulation than has been possible heretofore.

These and other objects and advantages of the invention will become more apparent from the following detailed description when taken in conjunction with the accompanying drawings.

DETAILED DESCRIPTION OF THE PREFERRED EMBODIMENT

Figure 1:
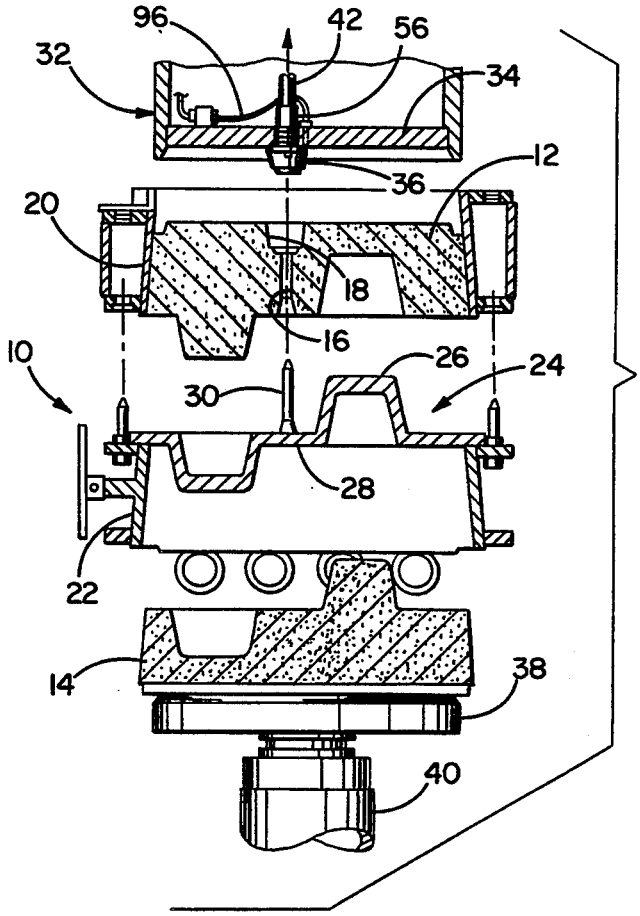
FIG. 1 is a somewhat schematic vertical cross-sectional view of the squeeze heads, the molding flasks and the pattern plate of a new and improved matchplate molding machine incorporating the unique features of the present invention.

For purposes of illustration, the invention has been shown in the drawings as embodied in a matchplate molding machine 10 for making green sand molds of the type used by foundries to form metal castings. An overall mold typically includes an upper cope mold 12 and a lower drag mold 14 which eventually abut one another to define a cavity having the shape of the part to be cast. Molten metal is introduced into the cavity through a vertically extending sprue 16 formed in the cope mold 12. To facilitate pouring of the metal into the sprue 16, an enlarged pouring basin 18 is formed in the upper side of the cope mold 12 adjacent the upper end of the sprue 16.

The machine includes cope and drag flasks 20 and 22 in which the cope and drag molds 12 and 14, respectively, are formed. A pattern plate or matchplate 24 is adapted to be located between the flasks 20, 22 and carries cope and drag patterns 26, 28 which coact to form the cavity in the ultimate mold. The upper side of the matchplate 24 carries a vertically extending sprue former 30 which is in the form of an elongated plastic finger and which effects formation of the sprue 16 in the cope mold 12.

Located above the cope flask 20 is a vertically fixed squeeze head 32 having a lower horizontal squeeze plate 34 whose lower side carries a basin former 36. The latter is aligned vertically with the sprue former 30 and serves to create the pour basin 18 in the upper side of the cope mold 12.

FIG. 1 shows the various components of the machine in the positions such components occupy after the cope and drag molds 12, 14 have been formed and just after the molds have been separated from the matchplate 24. In this position, the drag mold 14 has been lowered from the drag flask 22 and rests on a lower squeeze head 38 which is adapted to be moved vertically by a reciprocating hydraulic actuator 40. Formation of the molds 12, 14 is effected by filling the flasks 20, 22 with sand and by moving the lower squeeze head 38 upwardly. As explained in detail in Hunter U.S. Pat. No. 4,840,218, the disclosure of which is incorporated herein by reference, this results in the sand in the drag flask 22 being compacted between the lower squeeze head 38 and the lower side of the matchplate 24 and results in the sand in the cope flask 20 being compacted between the upper side of the matchplate 24 and the lower side of the squeeze plate 34 of the upper squeeze head 32.

As the matchplate 24 moves upwardly toward the squeeze plate 34, the sprue former 30 telescopes into the basin former 36. As a result, sand may be pushed upwardly from the cope flask 20 and into the basin former 36 by the sprue former 30. In prior arrangements, the sand either falls from the basin former 36 and into the newly formed basin and sprue as the cope mold 12 and matchplate 24 are drawn downwardly from the squeeze plate 34 or is blown upwardly through a discharge tube 42 via a one-piece plastic liner contained in the basin former 36.

In accordance with the present invention, sand is ejected upwardly out of the basin former 36 by pressurized air which is introduced into the basin former 36 through a unique two-piece liner 44 located in the basin former 36. One member of the liner is a relatively short plastic sleeve which is adapted to telescopically receive the sprue former 30 and can be replaced at a lower cost than conventional one-piece liners. Further, unique air passages established through the liner create better circulation inside the liner than previously available. By virtue of blowing sand out of the basin former 36 by means of air introduced through the liner 44, virtually no sand drops downwardly into the newly formed basin when the sprue former 30 is pulled downwardly out of the basin former 36.

Figure 5:
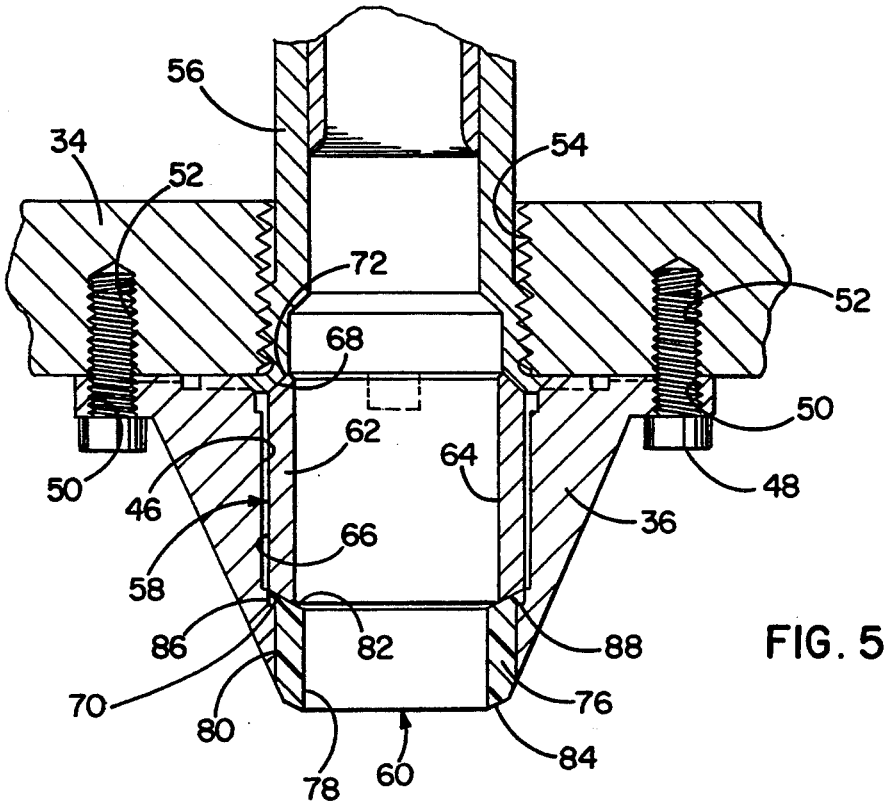
FIG. 5 is an enlarged fragmentary cross-section taken substantially along the line 5—5 of FIG. 3.

More specifically, the basin former 36 herein is a cast metal member which is formed with a vertically extending and generally cylindrical passage or bore 46. Referring to FIG. 5, two screws 48 extend through vertically extending holes 50 formed through the basin former 36 adjacent the bore 46 and are threaded into tapped holes 52 formed in the lower side of the squeeze plate 34. The screws 48 clamp the basin former 36 to the squeeze plate 34 in a position in which the bore 46 is concentric with a threaded hole 54 formed vertically through the squeeze plate. A tubular fitting 56 is threaded into the hole 54 and its upper end receives the flexible sand discharge tube 42 (best seen in FIG. 1) which leads to a sand receptacle (not shown). Sand is blown out of the basin former 36 through the tube 42 and is delivered to the sand receptacle.

The two-piece liner 44 is disposed in the bore 46 of the basin former 36 and is a two-piece tubular assembly which has a top member 58 preferably made of aluminum and a bottom member 60 preferably made of plastic. Significantly, the plastic bottom member is only about half as long as the metal top member.

Figure 2:
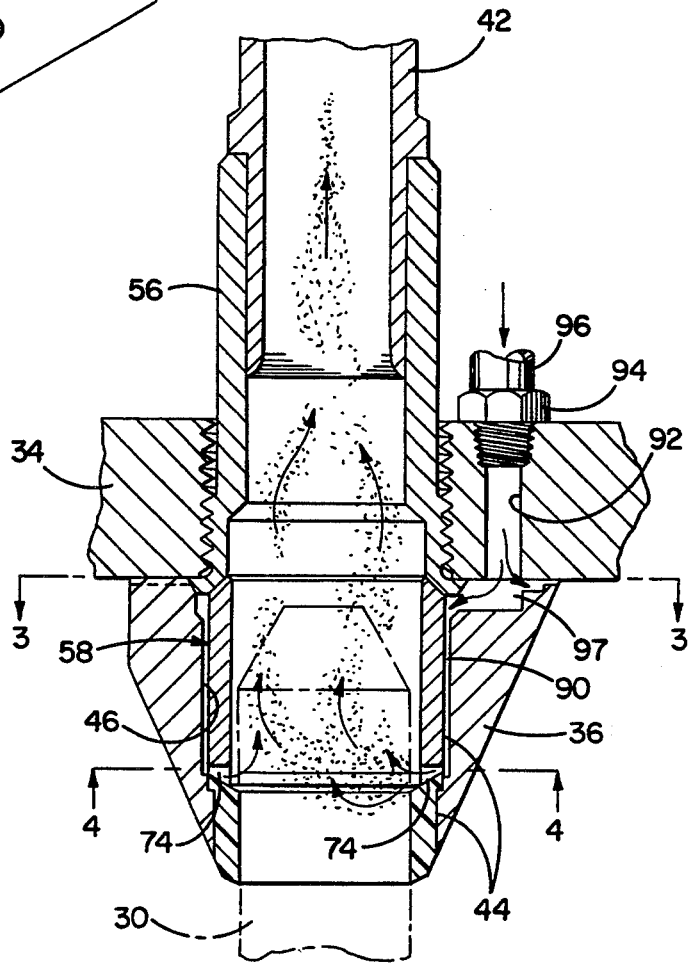
FIG. 2 is an enlarged fragmentary cross-sectional view of certain components shown in FIG. 1.
Figure 4:
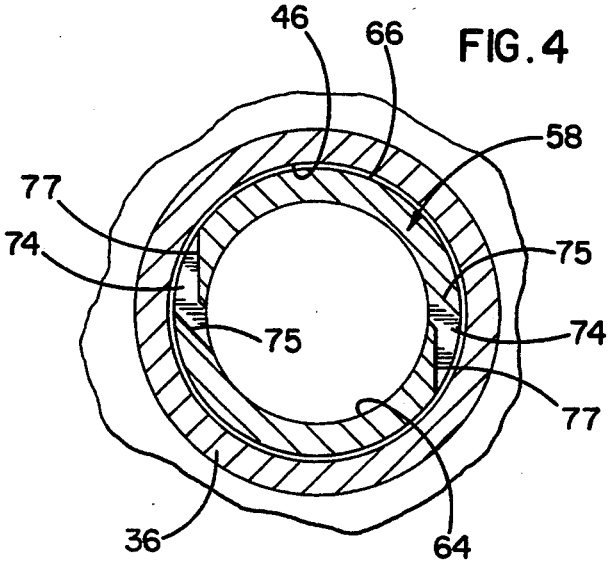
FIG. 4 is an enlarged fragmentary cross-section taken substantially along the line 4—4 of FIG. 2.

The top member 58 of the liner 44 includes a vertical side wall 62 forming a substantially cylindrical interior surface 64 and a substantially cylindrical exterior surface 66 terminating in two oppositely facing end surfaces 68 and 70. The diameter of the interior surface 64 is larger than the outside diameter of sprue former 30, thus preventing frictional wear. The exterior surface 66 of the top member 58 tapers inwardly at the upper end portion toward the interior surface 64 to form the top end surface 68. Top surface 68 seats against a complementary taper 72 formed in the lower end of the fitting 56 so as to establish a tight seal between the top member of the liner 58 and the fitting 56. The bottom surface 70 tapers inwardly upon progressing downwardly. Two air slots 74 (best seen in FIGS. 2 and 4) are formed in the bottom surface 70 and connect the external surface 66 to the internal surface 64 in a generally tangential direction. Each slot 74 includes a relatively straight side 75 (FIG. 4) and an opposite side 77 which flares outwardly away from the straight side upon progressing toward the exterior surface 66, so as to create a swirling effect inside the liner when air is injected through and along the slot.

Referring to FIG. 5, the bottom member 60 of the liner includes a vertical tubular side wall 76 forming a substantially cylindrical interior surface 78 and substantially cylindrical exterior surface 80, terminating in two oppositely facing end surfaces 82 and 84. An annular collar 86 is formed around the upper end portion of the bottom member 60 of the liner and seats against a shoulder 88 defined in the basin former 36 at the lower end of the bore 46. The interior surface 78 of the bottom member 60 flares outwardly at the upper end portion to form the top surface 82, which seats against the tapered bottom surface 70 of the top member 58 (see FIG. 5). The interior surface 78 is sized to telescopically receive the sprue former 30 with a snug but slidable fit. The lower end portion of the exterior surface 80 is tapered downwardly and inwardly to form the bottom surface 84.

A channel 90 (FIG. 2) is formed in the basin former 36 and opens into the bore 46. The channel 90 is located outwardly of the two-piece liner 44 and its upper end communicates with a vertical hole or port 92 formed through the squeeze plate 34. A fitting 94 is threaded into the port 92 and is connected to a flexible line 96 which communicates with a source of pressurized air.

The slots 74 in the top member 58 of the liner communicate with the channel 90. With the foregoing arrangement, pressurized air from the line 96 is admitted into the channel 90 via the port 92 and flows into the liner 44 through the slots 74. Sand pushed into the liner 44 by the sprue former 30 is entrained in the air and is blown upwardly through the discharge tube 42. The combination of the flared top surface 82 of the bottom member 60 and the fact that the air enters the liner 44 in a tangential direction creates a swirling high velocity air flow, helping to insure against sand being trapped in the corner at the junction of the interior surface 78 of the bottom member 60 and the sprue former 30. The tangential slots 74 and the flare of the upper surface 82 of the bottom member 60 cause the sand to be swept upwardly and to become entrained in the air stream.

Figure 3:
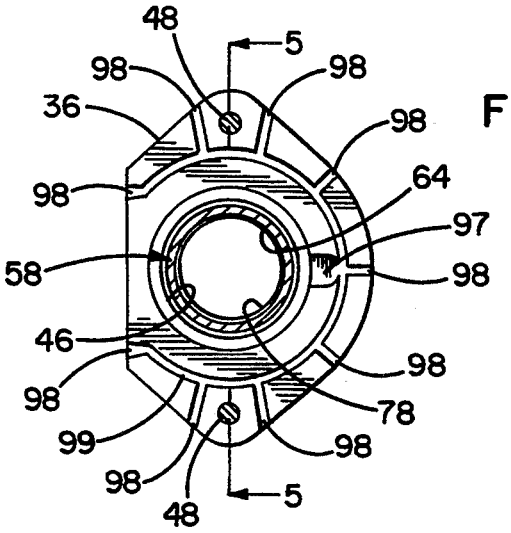
FIG. 3 is a reduced cross-section taken substantially along the line 3—3 of FIG. 2.

Advantageously, a chamber 97 (FIG. 3) is defined in the upper end portion of the basin former 36 above the bore 46 and communicates with the port 90. Several angularly spaced passageways 98 are formed in and open upwardly from the upper end of the basin former 36 and lead from the chamber 97 via an annular passageway 99 to the outer side of the basin former. When the port 90 is pressurized, air in the chamber 97 is discharged through the passageways 98 in the form of pressurized jets which sweep outwardly across the upper side of the cope mold 12 to clean loose sand therefrom and to prevent such sand from being drawn into the basin 18 by the vacuum which is inherently created when the cope mold is retracted downwardly from the basin former 36.

From the foregoing, it will be apparent that the present invention brings to the art a molding machine 10 with a new and improved basin former 36 in which sand is ejected upwardly by pressurized air injected through openings in a two-piece liner 44. The plastic bottom member 60, with a snug slidable fit over the sprue former 30, reduces the amount of loose sand which enters the basin former 36. Because, only the relatively short bottom member 60 is susceptible to wear from both the sprue former 30 and sand, it may be replaced at relatively low cost when wear occurs.

I claim:

1. In a molding machine, the combination of, a pattern plate having an upwardly extending sprue former, a cope flask located above said pattern plate, a squeeze head located above said cope flask, said pattern plate and said cope flask being adapted to be closed vertically relative to said squeeze head to pack sand in said cope flask against said pattern plate and thereby form a cope mold having a sprue, a basin former extending downwardly from said squeeze head for forming a pouring basin in the upper side of said mold adjacent the upper end of said sprue, said basin former having a vertically extending passage therethrough, a sand discharge tube communicating with the upper end of said passage, a tubular liner disposed within said passage and communicating with said discharge tube, said molding machine being characterized in that said liner comprises;

two separately formed tubular top and bottom members each having upper and lower end portions; said top member being axially aligned with said bottom member; one end portion of one of said members being formed with a plurality of slots and being seated against the adjacent end portion of the other of said members thereby forming a plurality of openings in said liner; said openings communicating with the interior of said liner, and means for admitting a flow of pressurized air through said openings and into the interior of said liner thereby to blow loose sand from said liner and into said discharge tube.

2. A molding machine as defined in claim 1 in which said slots are formed in the lower end portion of said top member.

3. A molding machine as defined in claim 1 in which said slots have tangentially extending sections for causing swirling of said air as the air is admitted into said liner.

4. A molding machine as defined in claim 1 in which said top member is made of metal.

5. A molding machine as defined in claim 4 in which said bottom member is made of plastic.

6. A molding machine as defined in claim 5 in which said plastic bottom member is significantly shorter than said metal top member.

* * * * *